US009910389B1

(12) United States Patent
Ogasawara

(10) Patent No.: US 9,910,389 B1
(45) Date of Patent: Mar. 6, 2018

(54) IMAGE FORMING APPARATUS THAT PRESSES SHEETS BEFORE IMAGE FORMING AND METHOD OF FORMING AN IMAGE

(71) Applicants: KABUSHIKI KAISHA TOSHIBA, Tokyo (JP); TOSHIBA TEC KABUSHIKI KAISHA, Tokyo (JP)

(72) Inventor: Masato Ogasawara, Katsushika Tokyo (JP)

(73) Assignees: Kabushiki Kaisha Toshiba, Tokyo (JP); Toshiba TEC Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/392,249

(22) Filed: Dec. 28, 2016

(51) Int. Cl.
*G03G 15/00* (2006.01)
*G03G 15/16* (2006.01)

(52) U.S. Cl.
CPC ..... *G03G 15/161* (2013.01); *G03G 15/5054* (2013.01)

(58) Field of Classification Search
CPC ..... G03G 15/161; G03G 15/5054
See application file for complete search history.

(56) References Cited

U.S. PATENT DOCUMENTS 4,801,134 A * 1/1989 Yokoyama ..... B65H 3/46 271/122
5,351,945 A * 10/1994 Asakawa ..... B65H 3/5261 271/118
2012/0195667 A1* 8/2012 Baxter ..... B65H 5/062 399/401
2016/0282796 A1* 9/2016 Tanaka ..... G03G 15/6582
2017/0183175 A1* 6/2017 Yokoyama ..... B65H 3/0676

FOREIGN PATENT DOCUMENTS

JP 3555663 B2 8/2004

* cited by examiner

*Primary Examiner* — G. M. Hyder
(74) *Attorney, Agent, or Firm* — Patterson & Sheridan, LLP

(57) ABSTRACT

An image forming apparatus includes a pressing unit configured to press an image forming surface of a sheet with a first pressure, an image carrier configured to hold a toner image, a transfer unit disposed downstream with respect to the pressing unit in a sheet conveying direction and configured to transfer the toner image on the image carrier to the sheet by pressing the sheet against the image carrier with a second pressure that is less than the first pressure, and a density sensor to detect density of toner held on the image carrier.

20 Claims, 7 Drawing Sheets

FIG. 6

| WEIGHTING OF SECONDARY TRANSFER ROLLER (N) | WIDTH OF NIP (mm) | PRESSURE OF SECONDARY TRANSFER ROLLER ($N/mm^2$) | QUANTITY OF TONERS ($mg/cm^2$) | |
|---|---|---|---|---|
| | | | BEFORE FEEDING PAPER | AFTER FEEDING PAPER CORRESPONDING TO 50,000 SHEETS |
| 9.81 | 1.5 | 0.0218 | 0.52 | 0.52 |
| 19.61 | 2.4 | 0.0273 | | 0.55 |
| 29.42 | 3 | 0.0327 | | 0.59 |
| 39.23 | 3.3 | 0.0396 | | 0.62 |
| 49.03 | 3.5 | 0.0467 | | 0.65 |

FIG. 7

| PRESSURE OF PRESSURE APPLYING UNIT ($N/mm^2$) | QUANTITY OF TONERS | |
|---|---|---|
| | BEFORE FEEDING PAPER | AFTER FEEDING PAPER CORRESPONDING TO 50,000 SHEETS |
| 0.0164 | 0.52 | 0.58 |
| 0.0245 | | 0.58 |
| 0.0327 | | 0.56 |
| 0.0491 | | 0.54 |
| 0.0654 | | 0.53 |
| 0.0981 | | 0.53 |

IMAGE FORMING APPARATUS THAT PRESSES SHEETS BEFORE IMAGE FORMING AND METHOD OF FORMING AN IMAGE

FIELD

Embodiments described herein relate generally to an image forming apparatus and an image forming method.

BACKGROUND

An image forming apparatus of one type forms a toner image on an image carrier and transfers the toner image on the image carrier to a recording medium. The image forming apparatus includes a toner adhesion detection unit that detects quantity of toners formed on the image carrier. The image forming apparatus adjusts a bias voltage or the like that is used in forming the toner image on the image carrier based on the quantity of toners detected by the toner amount detection unit.

To transfer the toner image on the image carrier to the recording medium, the image forming apparatus brings the recording medium into pressure contact with the image carrier. The recording medium usually includes a hard additive such as filler. For that reason, if the recording medium comes into pressure contact with image carrier, the additive can minutely damage a surface of the image carrier. If the surface of the image carrier is minutely damaged, accurate detection of the quantity of toners may be compromised. As a result, desired image density may not be obtained.

DESCRIPTION OF THE DRAWINGS

FIG. 6 illustrates evaluation results according to a comparative example.

FIG. 7 illustrates evaluation results according to an example of the present embodiment.

DETAILED DESCRIPTION

An image forming apparatus includes a pressing unit configured to press an image forming surface of a sheet with a first pressure, an image carrier configured to hold a toner image, a transfer unit disposed downstream with respect to the pressing unit in a sheet conveying direction and configured to transfer the toner image on the image carrier to the sheet by pressing the sheet against the image carrier with a second pressure that is less than the first pressure, and a density sensor to detect density of toner held on the image carrier.

Hereinafter, an image forming apparatus according to an embodiment will be described with reference to the accompanying drawings.

First Embodiment

Figure 1:
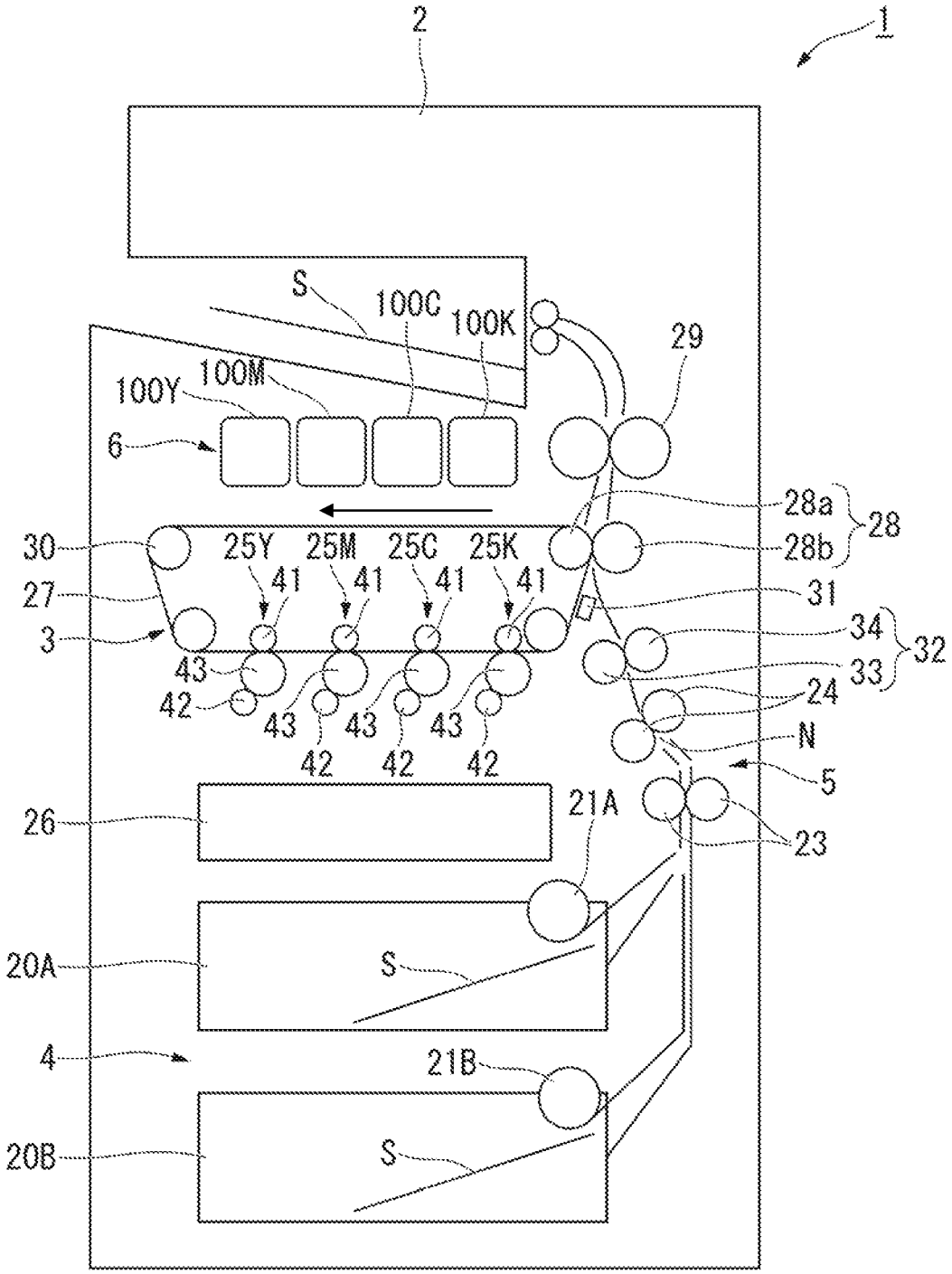
FIG. 1 schematically illustrates a structure of an image forming apparatus according to a first embodiment.

FIG. 1 schematically illustrates a structure of an image forming apparatus according to a first embodiment.

As illustrated in FIG. 1, an image forming apparatus 1 includes a scanner unit 2, a printer unit 3, a sheet storage unit 4 (image forming medium supply unit), a transport unit 5, and a toner replenishing unit 6. Hereinafter, it is assumed that the image forming apparatus 1 is placed on a horizontal surface. In addition, a side of the image forming apparatus 1, which is illustrated in FIG. 1, is referred to as a front side, and an opposite side is referred to as a rear side.

The scanner unit 2 reads an image of an object and generates image data. The scanner unit 2 sends the generated image data to the printer unit 3.

The printer unit 3 forms an image (hereinafter, referred to as "toner image") with a developer including toners and the like based on the image data received from the scanner unit 2 or an external device such as a client PC. The printer unit 3 transfers the toner image onto a surface (transfer surface, image forming surface) of a sheet S (image forming medium). The printer unit 3 fixes the toner image on the sheet S by applying heat and pressure to the toner image on the surface of the sheet S.

The sheet storage unit 4 supplies the sheet S to the printer unit 3 one by one. The sheet storage unit 4 includes a plurality of cassettes 20A and 20B. Each of the cassettes 20A and 20B stores sheets having a predetermined size and of a predetermined type. The cassettes 20A and 20B include pick-up rollers 21A and 21B, respectively. The pick-up rollers 21A and 21B pick up sheets one by one from the cassettes 20A and 20B, respectively. The pick-up rollers 21A and 21B supply the picked-up sheet S to the transport unit 5.

The transport unit 5 includes transport rollers 23 and registration rollers 24. The transport unit 5 transports the sheet S supplied from the pick-up rollers 21A and the sheet S supplied from the pick-up roller 21B, to the registration rollers 24. The registration rollers 24 transport the sheet S according to a timing at which the printer unit 3 transfers the toner image to the sheet S. The transport rollers 23 causes the edge of the sheet S in a transport direction to abut against a nip N of the registration rollers 24. The transport rollers 23 adjust the position of the edge of the sheet S in the transport direction (sheet conveying direction) by bending the sheet S. The registration rollers 24 align the edge of the sheet S, which is transported from the transport rollers 23, in the nip N. Furthermore, the registration rollers 24 transport the sheet S to a transfer unit 28.

Toner cartridges 100Y, 100M, 100C, and 100K, which store toners, are mounted in the toner replenishing unit 6. The toner cartridges 100Y, 100M, 100C, and 100K store toners of yellow, magenta, cyan, and black, respectively.

The printer unit 3 includes image forming units 25Y, 25M, 25C, and 25K, an exposure unit 26, an intermediate transfer belt 27 (toner image carrier), the transfer unit 28, and a fixing unit 29.

Each of the image forming units 25Y, 25M, 25C, and 25K forms a toner image, which is to be transferred to the sheet S, on the intermediate transfer belt 27. The intermediate transfer belt 27 is an endless belt. The intermediate transfer belt 27 holds the toner images on an outer surface thereof. Tension is given to the intermediate transfer belt 27 by a plurality of rollers which is in contact with an inner surface of the intermediate transfer belt 27. The intermediate transfer belt 27 is stretched in a flat shape. The inner surface of the intermediate transfer belt 27 is in contact with a supporting roller 28*a* and a transfer belt roller 30 at positions which are most separated in a stretching direction.

The supporting roller 28*a* is a part of the transfer unit 28. The supporting roller 28*a* guides the intermediate transfer belt 27 to a secondary transfer position.

The transfer belt roller 30 guides the intermediate transfer belt 27 to a cleaning position.

On the lower side of the intermediate transfer belt 27, the image forming units 25Y, 25M, 25C, and 25K are arranged in this order from the transfer belt roller 30 toward the transfer unit 28. The image forming units 25Y, 25M, 25C, and 25K are arranged in an area between the transfer belt roller 30 and the supporting roller 28*a* separately from each other. The image forming units 25Y, 25M, 25C, and 25K include photosensitive drums 43. The photosensitive drums 43 rotate in synchronization with the rotation of the intermediate transfer belt 27.

A developing unit 42, a primary transfer roller 41, a charging unit, a photosensitive cleaning unit, and a static eliminator (not showing in the drawing) are arranged around each photosensitive drum 43.

The developing unit 42 supplies toner to an electrostatic latent image formed on the surface of the photosensitive drum 43. The developing unit 42 stores a developer including the toner and carriers therein.

The primary transfer roller 41 is a conductive roller. The primary transfer roller 41 is in pressure contact with the photosensitive drum 43 through the intermediate transfer belt 27. In addition, a transfer bias voltage is applied to the primary transfer roller 41. As a result, the toner image is transferred (primarily transferred) to the intermediate transfer belt 27.

The respective developing units 42 of the image forming units 25Y, 25M, 25C, and 25K store yellow, magenta, cyan, and black toners. The toners, which are stored in the respective developing units 42, are supplied from the toner cartridges 100Y, 100M, 100C, and 100K.

The exposure unit 26 faces the photosensitive drums 43 of the image forming units 25Y, 25M, 25C, and 25K. The exposure unit 26 irradiates the surfaces of the photosensitive drums 43 with laser light of which emission is controlled based on the image data. The yellow, magenta, cyan, and black image data are supplied to the exposure unit 26. The exposure unit 26 irradiates the respective charged photosensitive drums 43 with laser light based on the yellow, magenta, cyan, and black image data. The exposure unit 26 forms electrostatic latent images on the surfaces of the photosensitive drums 43 based on the image data.

The image forming unit 25Y develops the electrostatic latent image formed by the laser light from the exposure unit 26 with the yellow toner. That is, the image forming unit 25Y forms a yellow toner image on the surface of the photosensitive drum 43. The image forming unit 25M develops the electrostatic latent image formed by the laser light from the exposure unit 26 with the magenta toner. That is, the image forming unit 25M forms a magenta toner image on the surface of the photosensitive drum 43. The image forming unit 25C develops the electrostatic latent image formed by the laser light from the exposure unit 26 with the cyan toner. That is, the image forming unit 25C forms a cyan toner image on the surface of the photosensitive drum 43. The image forming unit 25K develops the electrostatic latent image formed by the laser light from the exposure unit 26 with the black toner. That is, the image forming unit 25K forms a black toner image on the surface of the photosensitive drum 43.

The image forming units 25Y, 25M, 25C, and 25K transfer (primarily transfer) the toner images on the surfaces of the photosensitive drums 43 onto the intermediate transfer belt 27. The image forming units 25Y, 25M, 25C, and 25K apply a transfer bias to the toner images in the respective primary transfer positions. The image forming units 25Y, 25M, 25C, and 25K transfer the respective color toner images onto the intermediate transfer belt 27 in a superimposed manner. The image forming units 25Y, 25M, 25C, and 25K form the color toner image on the intermediate transfer belt 27.

The transfer unit 28 is disposed downstream of the image forming unit 25K in a rotation direction of the intermediate transfer belt 27. The transfer unit 28 pinches the intermediate transfer belt 27 and the sheet S in a state in which the intermediate transfer belt 27 overlaps the sheet S. The transfer unit 28 transfers the toner image on the outer surface of the intermediate transfer belt 27 onto the surface of the sheet S at the secondary transfer position. The secondary transfer position is a position at which the supporting roller 28*a* faces a secondary transfer roller 28*b*. The secondary transfer roller 28*b* rotates around a shaft extending along front and rear directions. The secondary transfer roller 28*b* presses the sheet S, which passes between the supporting roller 28*a* and the secondary transfer roller 28*b*, against the outer surface of the intermediate transfer belt 27 at a second pressure. The transfer unit 28 applies a transfer bias, which is controlled using a transfer current, to the secondary transfer position. The transfer unit 28 transfers the toner image on the intermediate transfer belt 27 onto the sheet S using the transfer bias.

The fixing unit 29 fixes the toner image on the surface of the sheet S to the sheet S using heat and pressure which are applied to the sheet S.

The printer unit 3 further includes a toner amount detection unit (density sensor) 31 and a pressure applying unit (pressing unit) 32.

The toner amount detection unit 31 is disposed upstream of the transfer unit 28 in a moving direction of the toner image which is held on the outer surface of the intermediate transfer belt 27. In other words, the toner amount detection unit 31 is disposed upstream of the transfer unit 28 in the rotation direction of the intermediate transfer belt 27. The toner amount detection unit 31 is disposed between the image forming unit 25 and the transfer unit 28 in the moving direction of the toner image. The toner amount detection unit 31 is disposed to face the outer surface of the intermediate transfer belt 27. The toner amount detection unit 31 detects amount of the toner formed on the outer surface of the intermediate transfer belt 27. The toner amount detection unit 31 includes a light emitting unit, a light reception unit, and an adjustment unit. The light emitting unit irradiates the outer surface of the intermediate transfer belt 27 with light. The light reception unit detects quantity of light which is emitted from the light emitting unit and is reflected by the outer surface of the intermediate transfer belt 27. The adjustment unit controls quantity of light which is emitted from the light emitting unit. The toner amount detection unit 31 detects amount of the toner to the outer surface of the intermediate transfer belt 27.

The pressure applying unit 32 is disposed between the sheet storage unit 4 and the transfer unit 28. Specifically, the pressure applying unit 32 is disposed upstream of the transfer unit 28 and downstream of the registration rollers 24 of the transport unit 5 in the transport direction of the sheet S.

The pressure applying unit 32 presses the surface of the sheet S at a first pressure which is higher than the second pressure. The first pressure is equal to or higher than twice the second pressure. The pressure applying unit 32 includes a first roller 33 and a second roller 34. The first roller 33 and the second roller 34 pinch the sheet S, which is transferred, therebetween. The first roller 33 is disposed in a position which faces the surface of the sheet S. The second roller 34 is disposed on a side opposite to the first roller 33 while pinching the sheet S therebetween. That is, the second roller 34 is disposed in a position which faces a rear surface of the sheet S.

Figure 2:
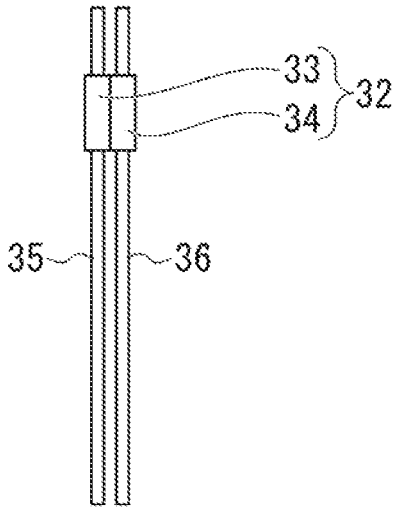
FIG. 2 is a plan view of a pressure applying unit of the image forming apparatus according to the first embodiment.

FIG. 2 is a plan view of the pressure applying unit 32 according to the first embodiment.

As illustrated in FIG. 2, the first roller 33 is formed in a cylindrical shape which has an axis extending along the front and rear directions as a center axis. The first roller 33 is fixed to a first shaft portion 35. The first shaft portion 35 extends along the front and rear directions. The first shaft portion 35 is supported to be capable of rotating around an axis extending along the front and rear directions. The first roller 33 is formed of, for example, a metal material or a resin material which has stiffness.

The second roller 34 is formed in a cylindrical shape which has an axis extending along the front and rear directions as a center axis. The second roller 34 is fixed to a second shaft portion 36. The second shaft portion 36 extends along the front and rear directions. The second shaft portion 36 is supported to be capable of rotating around an axis extending along the front and rear directions. The second roller 34 is formed of a rubber material. The surface of the second roller 34 has hardness of 50 degrees or higher according to JIS K6253. The first roller 33 and the second roller 34 are provided in an identical position in the front and rear directions.

Figure 3:
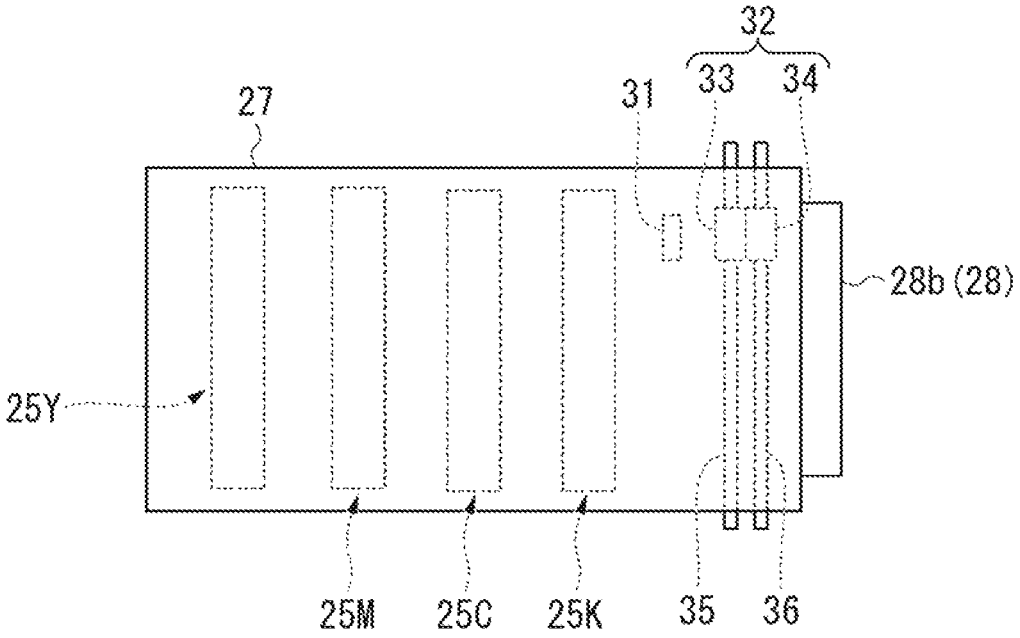
FIG. 3 schematically illustrates an inner configuration of the image forming apparatus according to the first embodiment.

FIG. 3 schematically illustrates an inner configuration of the image forming apparatus 1 according to the first embodiment.

As illustrated in FIG. 3, at least a part of the respective rollers 33 and 34 is disposed in a position which overlaps the toner amount detection unit 31 in a width direction of the image forming apparatus 1 (i.e., a width direction of the sheet S). In other words, the respective rollers 33 and 34 are provided in positions (on an approximately straight line) corresponding to the toner amount detection unit 31 in an axial direction (that is, the front and rear directions) of the secondary transfer roller 28*b*. Specifically, the respective rollers 33 and 34 are provided in a position corresponding to a spot on the intermediate transfer belt 27 detected by the toner amount detection unit 31 in the axial direction of the secondary transfer roller 28*b*. A part of the sheet S, which is pinched by the respective rollers 33 and 34, is pressed against the spot of the intermediate transfer belt 27, which is detected by the toner amount detection unit 31, in the transfer unit 28.

Hereinafter, an operation of the image forming apparatus 1 will be described.

The image forming apparatus 1 controls densities of the toner images which are formed on the surfaces of the photosensitive drums 43 in order to obtain a desired density of the image which is transferred to the sheet S. The image forming apparatus 1 controls the densities of the toner images which are formed on the surfaces of the photosensitive drums 43 such that quantity of toners on the intermediate transfer belt 27 becomes a reference value. Hereinafter, the reference value of the quantity of toners is referred to as a "reference quantity". The image forming apparatus 1 calculates the quantity of toners based on the quantity of reflected light which is detected by the light reception unit of the toner amount detection unit 31. Hereinafter, the quantity of reflected light which is detected by the light reception unit is referred to as a "quantity of reflected light". The image forming apparatus 1 controls the densities of the toner images which are formed on the surfaces of the photosensitive drums 43 such that the quantity of reflected light becomes a predetermined value.

Figure 4:
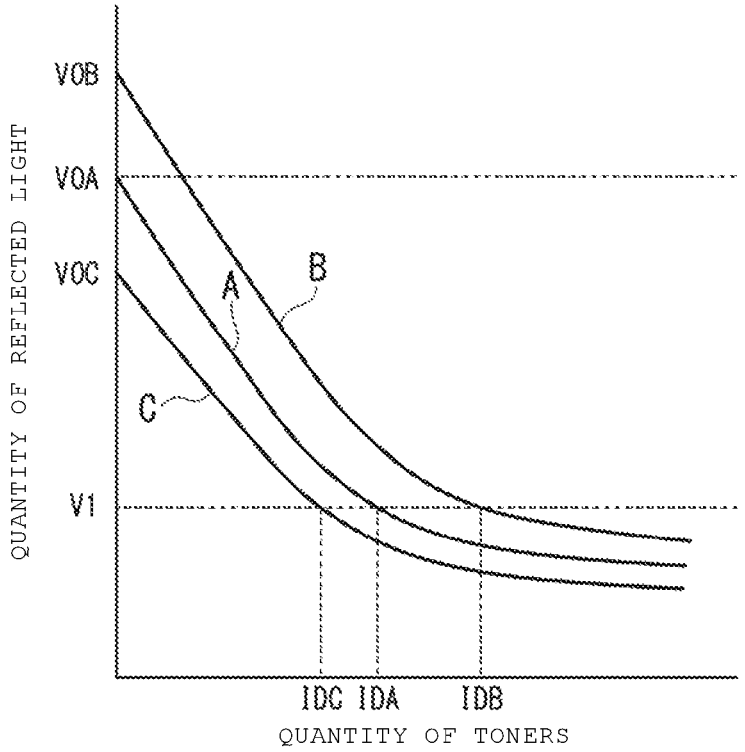
FIGS. 4 and 5 illustrate a relationship between quantity of toners and quantity of reflected light on an intermediate transfer belt.

FIG. 4 is a graph illustrating a relationship between the quantity of toners and the quantity of reflected light on the intermediate transfer belt. In FIG. 4, a horizontal axis indicates the quantity of toners formed on the outer surface of the intermediate transfer belt 27. In FIG. 4, a vertical axis indicates the quantity of reflected light. Curves A, B, and C, which are illustrated in FIG. 4, are obtained by changing the quantity of light which is emitted from the light emitting unit of the toner amount detection unit 31. Hereinafter, the quantity of light which is emitted from the light emitting unit is referred to as a "quantity of emitted light". The curve A is obtained when the quantity of emitted light is set to a condition that is a reference for calculation of the quantity of toners. Hereinafter, the condition which is the reference is referred to as a "reference condition". The curve B is obtained when the quantity of emitted light is larger than the reference condition. The curve C is obtained when the quantity of emitted light is smaller than the reference condition.

As illustrated in FIG. 4, the quantity of reflected light depends on the quantity of toners formed on the outer surface of the intermediate transfer belt 27, in a case in which the quantity of emitted light is fixed. Here, the quantity of reflected light that is obtained when the quantity of toners is a reference quantity IDA in the reference condition is defined as V1. As illustrated by the curve B of FIG. 4, when the quantity of emitted light is larger than the reference condition, the quantity of toners that is obtained when the quantity of reflected light is V1 is IDB which is larger than the reference attachment quantity IDA. As illustrated by the curve C of FIG. 4, when the quantity of emitted light is smaller than the reference condition, the quantity of toners that is obtained when the quantity of reflected light is V1 is IDC which is smaller than the reference quantity IDA.

The image forming apparatus 1 controls the quantity of emitted light such that the quantity of toners which is obtained when the quantity of reflected light is V1 is the reference quantity IDA. Specifically, the image forming apparatus 1 performs control such that the quantity of reflected light which is obtained when no toners are formed on the outer surface of the intermediate transfer belt 27 is quantity of reflected light V0A in the reference condition. Hereinafter, the state in which no toners are formed on the outer surface of the intermediate transfer belt 27 is referred to as a "non-adhesion state". When the quantity of reflected light in the non-adhesion state is V0B that is larger than V0A, the image forming apparatus 1 reduces the quantity of emitted light using the adjustment unit of the toner amount detection unit 31. When the quantity of reflected light in the non-adhesion state is V0C that is smaller than V0A, the image forming apparatus 1 increases the quantity of emitted light using the adjustment unit of the toner amount detection unit 31. Therefore, when the quantity of reflected light is V1, the quantity of toners is the reference quantity IDA. Hereinafter, the operation is referred to as "density adjustment".

The image forming apparatus 1 performs the density adjustment when electric power is supplied, printing corresponding to a predetermined number of sheets is performed, and printing starts after leaving the image forming apparatus unused for a predetermined time.

The sheet S contains a hard additive such as filler formed of calcium carbonate. The sheet S is pressed against the outer surface of the intermediate transfer belt 27 in the transfer unit 28 by the secondary transfer roller 28*b* at the second pressure. The additive contained in the sheet S can minutely damage the outer surface of the intermediate transfer belt 27. As a result, the quantity of reflected light in the non-adhesion state can be lowered when the outer surface of the intermediate transfer belt 27 is damaged.

Figure 5:
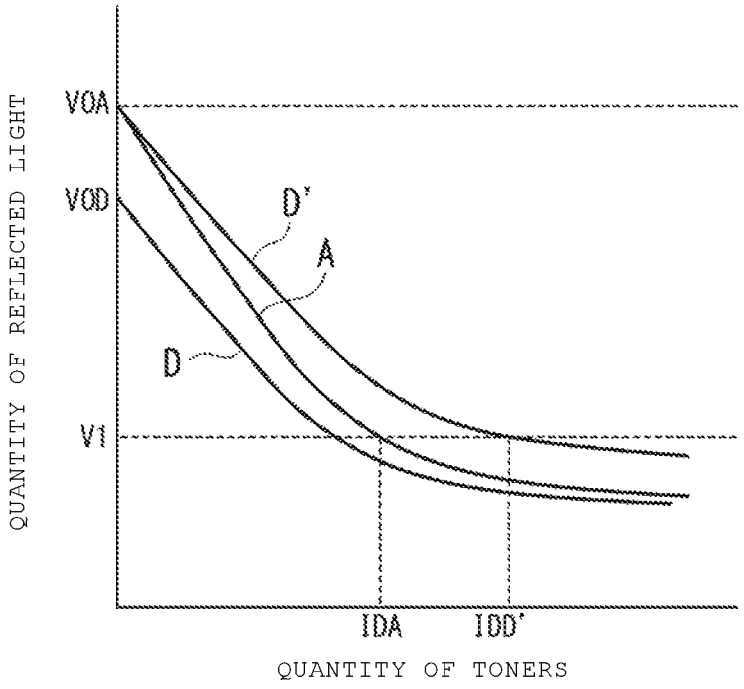

FIG. 5 illustrates the relationship between the quantity of toners and the quantity of reflected light on the intermediate transfer belt. In FIG. 5, a horizontal axis indicates the quantity of toners formed on the outer surface of the intermediate transfer belt 27. In FIG. 5, a vertical axis indicates quantity of reflected light. A curve A is the same as the curve A illustrated in FIG. 4, and indicates a curve of the reference condition in a state in which the outer surface of the intermediate transfer belt 27 is not damaged. A curve D indicates a curve of the reference condition in a state in which the outer surface of the intermediate transfer belt 27 is minutely damaged. A curve D' indicates a case in which the quantity of emitted light is increased as compared to the state indicated by the curve D so that the quantity of reflected light that is obtained when no toners are formed is V0A.

As illustrated in FIG. 5, if the quantity of emitted light and the quantity of toners are kept constant, the minute damage on the outer surface of the intermediate transfer belt 27 decreases the quantity of reflected light. The quantity of reflected light in the non-adhered state becomes V0D which is smaller than V0A due to the minute damage on the outer surface of the intermediate transfer belt 27. If the density adjustment is performed in this state, the quantity of toners becomes IDD', which is larger than the reference quantity IDA, when the quantity of reflected light is V1. As a result, the image forming apparatus 1 miscalculates the quantity of toners. The image forming apparatus 1 controls the densities of the toner images which are formed on the surfaces of the photosensitive drums 43 such that the quantity of toners on the intermediate transfer belt 27 is larger than the reference quantity.

Hereinafter, an operation of the image forming apparatus 1 will be described based on a comparative example and an example.

Initially, the quantity of toners, which was obtained after feeding paper corresponding to 50,000 sheets and was evaluated using an image forming apparatus according to the comparative example, will be described. The image forming apparatus according to the comparative example does not include the pressure applying unit 32, unlike the image forming apparatus 1 according to the exemplary embodiment. The image forming apparatus according to the comparative example is different from the image forming apparatus of the exemplary embodiment in that the image forming apparatus according to the comparative example does not include the pressure applying unit 32.

FIG. 6 illustrates evaluation results according to the comparative example. A weighting of the secondary transfer roller illustrated in FIG. 6 is the weighting which is given to the secondary transfer roller 28*b*. A width of the nip illustrated in FIG. 6 is the width of the nip between the secondary transfer roller 28*b* and the intermediate transfer belt 27. A pressure of the secondary transfer roller illustrated in FIG. 6 is a pressure which is applied from the secondary transfer roller 28*b* to the outer surface of the intermediate transfer belt 27.

Evaluation conditions are as follows. The respective image forming units 25Y, 25M, 25C, and 25K formed four-colored toner images on the intermediate transfer belt 27 in the superimposed manner. The toner image on the intermediate transfer belt 27 was transferred to the sheet S in the transfer unit 28. A material of the intermediate transfer belt 27 was polyimide. The secondary transfer roller 28*b* was a rubber roller. The secondary transfer roller 28*b* had a diameter of 18 mm, an ASKER-C hardness of 35 degrees, and a width of 300 mm. The width of the nip was obtained by pinching a pressure-sensitive paper (Prescale manufactured by Fuji Film Co., Ltd.) between the secondary transfer roller 28*b* and the intermediate transfer belt 27 and measuring a width of a discolored part. The quantity of toners was calculated by extracting toners on the intermediate transfer belt 27 using a suction machine and measuring its weight. The quantity of toners was calculated immediately after the density adjustment.

First, a relationship between the weighting of the secondary transfer roller and the image density of the sheet S was evaluated. The image forming apparatus according to the comparative example brings transfer failure when the weighting is equal to or smaller than 23.52 N and a load is equal to or larger than 34.30 N.

Subsequently, a relationship among the weighting of the secondary transfer roller, the width of the nip, and the pressure of the secondary transfer roller was evaluated. Here, it is assumed that the weighting of the secondary transfer roller is set to F, the width of the secondary transfer roller 28*b* is set to L, the width of the nip between the secondary transfer roller 28*b* and the intermediate transfer belt 27 is set to W, and the pressure of the secondary transfer roller is set to P. The pressure P of the secondary transfer roller is defined as $P=F/(W\times L)$. As illustrated in FIG. 6, the width of the nip and the pressure of the secondary transfer roller increases as the weighting of the secondary transfer roller becomes large.

Subsequently, a relationship among the weighting of the secondary transfer roller, the quantity of toners which is obtained before feeding paper and the quantity of toners which is obtained after feeding paper corresponding to 50,000 sheets was evaluated. A state obtained before feeding paper indicates a state in which the outer surface of the intermediate transfer belt 27 is not damaged. As illustrated in FIG. 6, the quantity of toners, which was obtained before feeding paper, is 0.52 $mg/cm^2$ regardless of the weighting of the secondary transfer roller. The quantity of toners, which was obtained after feeding paper corresponding to 50,000 sheets, increases as the weighting of the secondary transfer roller becomes large.

Subsequently, the quantity of toners which was obtained after feeding paper corresponding to 50,000 sheets and was evaluated using the image forming apparatus according to the example will be described. An evaluation result of the example is obtained by sing the image forming apparatus 1 according to the exemplary embodiment.

FIG. 7 illustrates evaluation results according to the example. A pressure of the pressure applying unit illustrated in FIG. 7 is a pressure which is applied to the sheet S in the pressure applying unit 32.

The evaluation conditions are as follows. The first roller 33 of the pressure applying unit 32 was a roller which is formed of SUM 24L and had a diameter of 18 mm. The second roller 34 of the pressure applying unit 32 was a roller which was formed of ethylene-propylene-diene rubber and had a diameter of 18 mm. The surface of the second roller 34 had a hardness of 75 degrees according to JIS K6253. The pressure was calculated in the same manner as the pressure of the secondary transfer roller. That is, the pressure was calculated based on weighting applied to the first roller 33 and the second roller 34, and the width of the nip between the first roller 33 and the second roller 34. The weighting applied to the secondary transfer roller 28*b* was set to 29.42 N, which makes it possible to normally transfer images to the sheet S, based on the evaluation results of the image density. The other evaluation conditions were the same as in the image forming apparatus according to the comparative example.

As illustrated in FIG. 7, the quantity of toners, which was obtained before feeding paper, is 0.52 mg/cm$^2$ regardless of the pressure of the pressure applying unit. The quantity of toners, which was obtained after feeding paper corresponding to 50,000 sheets, decreases from 0.59 mg/cm$^2$ of the comparative example as the pressure of the pressure applying unit becomes large. The quantity of toners, which was obtained after feeding paper corresponding to 50,000 sheets, approaches the quantity of toners, which was obtained before feeding paper, as the pressure of the pressure applying unit becomes large. The quantity of toners, which was obtained after feeding paper corresponding to 50,000 sheets, is within a range in which a rise in image density does not cause a problem in a case in which the pressure of the pressure applying unit is larger than the pressure (0.0327 N/mm$^2$) of the secondary transfer roller. Particularly, there is little difference between the quantity of toners, which was obtained after feeding paper corresponding to 50,000 sheets, and the quantity of toners, which was obtained before feeding paper in a case in which the pressure of the pressure applying unit is equal to or larger than twice the pressure of the secondary transfer roller.

The image forming apparatus 1 according to the exemplary embodiment includes the pressure applying unit 32 that presses the surface of the sheet S at the first pressure which is higher than the second pressure. The pressure applying unit 32 is disposed between the sheet storage unit 4 and the transfer unit 28. According to this configuration, the image forming apparatus 1 can embed the additive in the sheet S supplied from the sheet storage unit 4 or make the shape of the additive smooth. When the sheet S is pressed against the intermediate transfer belt 27, the image forming apparatus 1 can prevent the additive from damaging the intermediate transfer belt 27. The image forming apparatus 1 can accurately detect the quantity of toners formed on the intermediate transfer belt 27. Therefore, the image forming apparatus 1 and an image forming method according to the exemplary embodiment can obtain desired image density.

The part of the pressure applying unit 32 is disposed in the position which overlaps the toner amount detection unit 31 along the width direction of the sheet S. It is possible to prevent the spot of the intermediate transfer belt 27 to be detected by the toner amount detection unit 31 from being damaged by the sheet S. Therefore, the image forming apparatus 1 can obtain desired image density.

Since the image forming apparatus 1 includes the intermediate transfer belt 27, it is possible to achieve the above-described effects in a so-called intermediate transfer system.

Since the pressure applying unit 32 includes the first roller 33 and the second roller 34 which pinch the sheet S therebetween, it is possible to easily press the surface of the sheet S.

Since the first roller 33 is formed of a metal material, it is possible to easily embed the additive in the sheet S or to make the shape of the additive smooth.

When a gap is generated between the first roller 33 and the second roller 34, it may be difficult for the pressure applying unit to accurately press the sheet S. The second roller 34 according to the exemplary embodiment is formed of a rubber material. Therefore, the pressure applying unit 32 can press the sheet S while suppressing a gap from being generated between the first roller 33 and the second roller 34.

The surface of the second roller 34 has a hardness of 75 degrees or higher according to JIS K6253. Therefore, the pressure applying unit 32 can press the sheet S while suppressing a gap from being generated between the first roller 33 and the second roller 34. The image forming apparatus 1 can prevent the additive from damaging the outer surface of the intermediate transfer belt 27. Accordingly, the image forming apparatus 1 can accurately detect the quantity of toners formed on the outer surface of the intermediate transfer belt 27, as illustrated in FIG. 7. Therefore, the image forming apparatus 1 can obtain desired image density.

Since the first pressure is equal to or higher than twice the second pressure, it is possible to more accurately detect the quantity of toners formed on the outer surface of the intermediate transfer belt 27 as illustrated in FIG. 7. Therefore, the image forming apparatus 1 can obtain desired image density.

Second Embodiment

Subsequently, an image forming apparatus 101 according to a second embodiment will be described.

Figure 8:
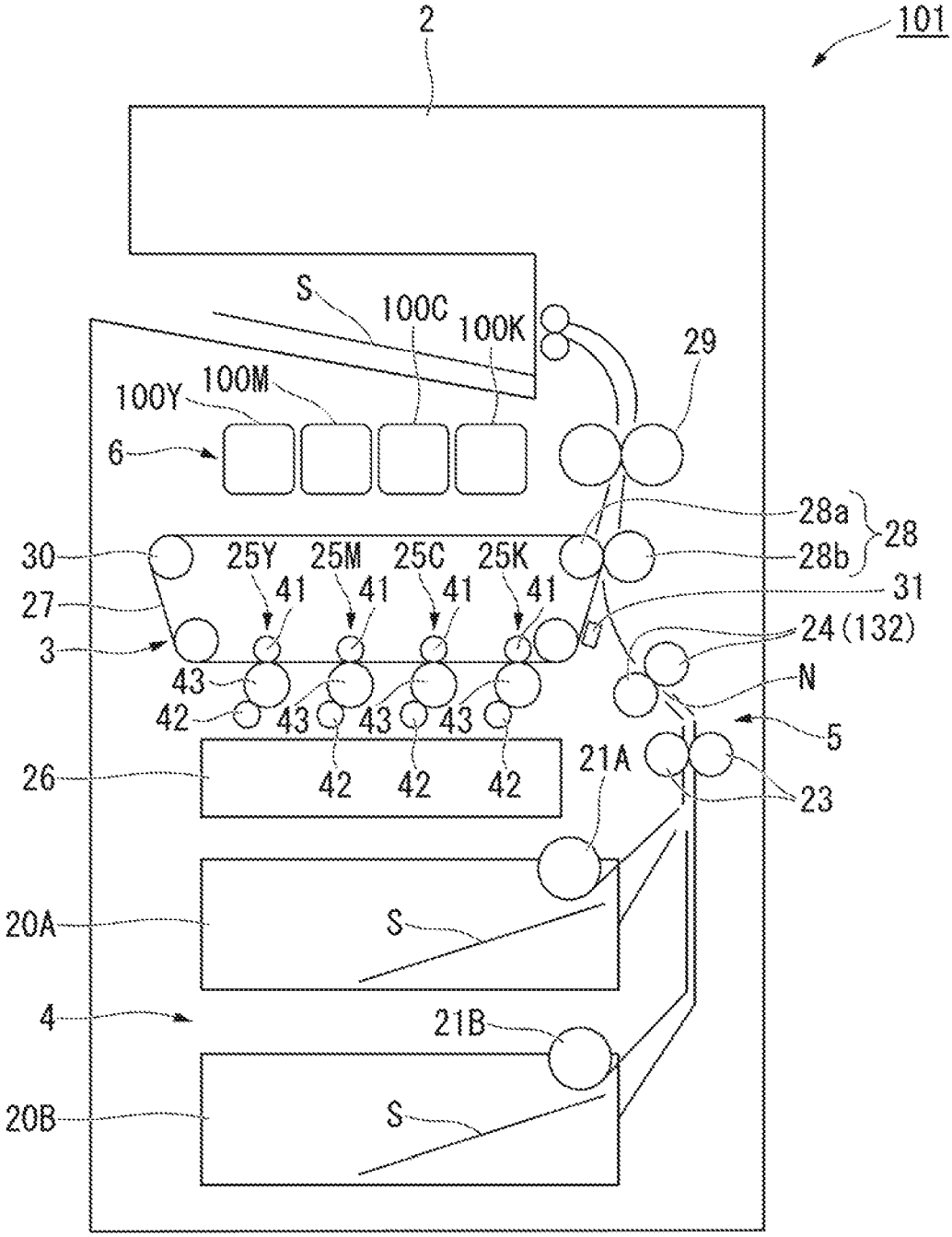
FIG. 8 schematically illustrates a structure of an image forming apparatus according to a second embodiment.

FIG. 8 schematically illustrates a structure of the image forming apparatus according to the second embodiment.

In the first embodiment illustrated in FIG. 1, the pressure applying unit 32 and the registration rollers 24 are provided separately. In contrast, the second embodiment illustrated in FIG. 8 is different from the first embodiment in that a pressure applying unit 132 is disposed in the registration rollers 24. Meanwhile, the same reference symbols are assigned to the same configurations as in the first embodiment illustrated in FIG. 1, and detailed description thereof will be omitted.

Figure 9:
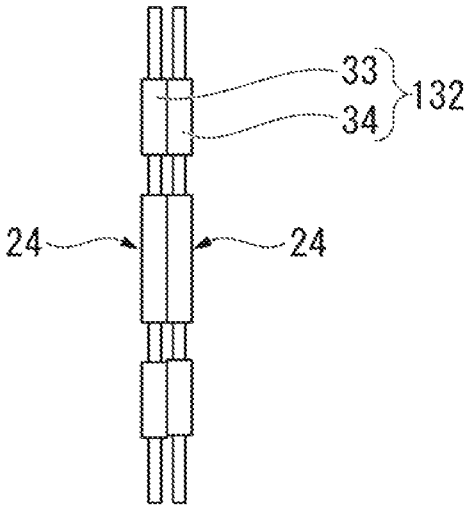
FIG. 9 is a plan view of a pressure applying unit of the image forming apparatus according to the second embodiment.

FIG. 9 is a plan view of the pressure applying unit 132 according to the second embodiment.

As illustrated in FIG. 9, the pressure applying unit 132 includes the first roller 33 and the second roller 34. The pressure applying unit 132 corresponds to a part of the registration rollers 24. The first roller 33 and the second roller 34 are fixed to the shaft portions of the registration rollers 24.

According to this configuration, it is possible to reduce the number of components, and thus it is possible to reduce the manufacturing cost of the image forming apparatus 101. In addition, since it is possible to reduce the number of components, it is possible to simplify the apparatus configuration, and thus it is possible to suppress the image forming apparatus 101 from increasing in size.

Meanwhile, the image forming apparatuses 1 and 101 according to the embodiments employ a so-called intermediate transfer system of transferring the toner image formed in the photosensitive drum 43 onto the sheet S through the intermediate transfer belt 27. However, the embodiments are not limited thereto. The image forming apparatus may employ a so-called direct transfer system of directly transferring a toner image formed in a photosensitive drum onto the sheet S. Here, when the image forming apparatus includes the pressure applying unit, it is possible to prevent the surface of the photosensitive drum (toner image carrier) from being damaged.

In addition, in the embodiments, the respective rollers 33 and 34 of the pressure applying units 32 and 132 are provided in only positions corresponding to the spot to be detected by the toner amount detection unit 31. However, the embodiments are not limited thereto, and the pressure applying unit may be provided in at least a position corresponding to a spot which is to be detected by the toner amount detection unit 31. For example, the pressure applying unit may include the first roller and the second roller which pinch the sheet S over the whole length in a width direction of the sheet S.

According to at least one embodiment described above, the image forming apparatus includes the pressure applying unit that presses the surface of the sheet at the first pressure which is higher than the second pressure. The pressure applying unit is disposed between the sheet storage unit and the transfer unit. According to this configuration, the image forming apparatus can embed the additive in the sheet supplied from the sheet storage unit or to make the shape of the additive smooth. When the sheet is pressed against the intermediate transfer belt, the image forming apparatus can prevent the additive from damaging the intermediate transfer belt. Accordingly, the image forming apparatus can accurately detect the quantity of toners formed on the intermediate transfer belt. Therefore, the image forming apparatus can obtain desired image density.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An image forming apparatus comprising:

a pressing unit configured to press an image forming surface of a sheet, prior to transferring any image thereon, with a first pressure;

an image carrier configured to hold a toner image;

a transfer unit disposed downstream with respect to the pressing unit in a sheet conveying direction and configured to transfer the toner image on the image carrier to the sheet by pressing the sheet against the image carrier with a second pressure that is less than the first pressure; and a density sensor to detect density of toner held on the image carrier.

2. The image forming apparatus according to claim 1, wherein a region of the image forming surface that is pressed by the pressing unit at least partially overlaps in a width direction with a region that is detected by the density sensor.

3. The image forming apparatus according to claim 1, wherein the image carrier comprises an endless transfer belt to which the toner image is transferred and from which the toner image is transferred to the sheet.

4. The image forming apparatus according to claim 1, wherein the pressing unit includes a first roller disposed to face the image forming surface of the sheet and a second roller facing the first roller.

5. The image forming apparatus according to claim 4, wherein a material of the first roller is harder than a material of the second roller.

6. The image forming apparatus according to claim 4, wherein the first roller is formed of metal and the second roller is formed of rubber.

7. The image forming apparatus according to claim 4, wherein a surface of the second roller has a hardness of 75 degrees or higher according to JIS K6253.

8. The image forming apparatus according to claim 1, further comprising:

a pair of registration rollers disposed upstream with respect to the pressing unit in the sheet conveying direction and configured to align an edge of the sheet.

9. The image forming apparatus according to claim 1, wherein the first pressure is greater than or equal to twice the second pressure.

10. A method of forming an image comprising:

pressing an image forming surface of a sheet, prior to transferring any image thereon, with a first pressure;

after the pressing, conveying the sheet to a transfer position;

at the transfer position, transferring a toner image formed on an image carrier to the image forming surface of the sheet by pressing the sheet against the image carrier with a second pressure that is less than the first pressure; and detecting density of toner held on the image carrier.

11. The method according to claim 10, wherein the detecting is carried out after the pressing and before the transferring.

12. The method according to claim 10, wherein a region of the image forming surface that is pressed by the pressing at least partially overlaps in a width direction with a region that is detected by the detecting.

13. The method according to claim 10, wherein the image forming surface of the sheet is pressed only partially in a width direction.

14. The method according to claim 10, wherein the image forming surface of the sheet is pressed entirely in a width direction.

15. The method according to claim 10, wherein the first pressure is greater than of equal to twice the second pressure.

16. An image forming apparatus comprising:

a pair of registration rollers configured to align an edge of a sheet;

a pair of pressing rollers disposed to rotate around a same rotational axis as the registration rollers, and configured to press an image forming surface of a sheet, prior to transferring any image thereon, with a first pressure;

an image carrier configured to hold a toner image;

a transfer unit disposed downstream with respect to the registration rollers in a sheet conveying direction and configured to transfer the toner image on the image carrier to the sheet by pressing the sheet against the image carrier with a second pressure that is less than the first pressure; and a density sensor to detect density of toner held on the image carrier.

17. The image forming apparatus according to claim 16, wherein a region of the image forming surface that is pressed by the pressing rollers at least partially overlaps in a width direction with a region that is detected by the density sensor.

18. The image forming apparatus according to claim 16, wherein the image carrier comprises an endless transfer belt to which the toner image is transferred and from which the toner image is transferred to the sheet.

19. The image forming apparatus according to claim 16, wherein the pressing rollers includes a first roller disposed to face the image forming surface of the sheet and a second roller facing the first roller, and a material of the first roller is harder than a material of the second roller.

20. The image forming apparatus according to claim 16, wherein the registration rollers are disposed between the pair of pressing rollers in a width direction of the sheet.

* * * * *